US012090598B2

(12) United States Patent
Godwin et al.

(10) Patent No.: US 12,090,598 B2
(45) Date of Patent: Sep. 17, 2024

(54) GLASSWARE POLISHING SYSTEM

(71) Applicant: Clear Consumer Products Group, LLC, Duxbury, MA (US)

(72) Inventors: Adam M. Godwin, Duxbury, MA (US); David Faherty, Duxbury, MA (US); Chris Ward, Hingham, MA (US)

(73) Assignee: Clear Consumer Products Group, LLC, Hingham, MA (US)

( * ) Notice: Subject to any disclaimer, the term of this patent is extended or adjusted under 35 U.S.C. 154(b) by 613 days.

(21) Appl. No.: 17/362,074

(22) Filed: Jun. 29, 2021

(65) Prior Publication Data

US 2021/0402545 A1 Dec. 30, 2021

Related U.S. Application Data

(60) Provisional application No. 63/045,450, filed on Jun. 29, 2020.

(51) Int. Cl.
*B24B 29/10* (2006.01)
*B24B 29/00* (2006.01)
*B24B 47/12* (2006.01)

(52) U.S. Cl.
CPC ..... *B24B 29/10* (2013.01); *B24B 29/005* (2013.01); *B24B 47/12* (2013.01)

(58) Field of Classification Search
CPC ..... A46B 2200/30; A46B 2200/3006; A46B 2200/3053; A46B 2200/3086; A47L 15/0068; A47L 21/02; B24B 29/10
USPC ..... 15/104.9
See application file for complete search history.

(56) References Cited

U.S. PATENT DOCUMENTS 2,748,409 A * 6/1956 Lyman ..... A47L 15/0068 15/75
2004/0134023 A1* 7/2004 Caruso ..... A47L 13/10 15/377
2008/0098540 A1* 5/2008 Chen ..... A63B 57/60 15/21.1
2013/0174365 A1* 7/2013 Amicon ..... A47L 15/0068 15/176.3

FOREIGN PATENT DOCUMENTS

DE 10305897 A1 * 7/2005 ..... A47L 15/4244
WO WO-2007078203 A1 * 7/2007 ..... D01F 1/103

OTHER PUBLICATIONS

DE-10305897-A1 translation (Year: 2005).*
WO-2007078203-A1 translation (Year: 2007).*

* cited by examiner

*Primary Examiner* — Abbie E Quann
(74) *Attorney, Agent, or Firm* — Lando & Anastasi, LLP

(57) ABSTRACT

A glassware polishing system includes a base and a wall extending upward from the base. The wall circumscribes and defines a chamber within an inner side of the wall. A first polishing head having a first spindle extends upward from the base within the chamber and has a polishing material disposed about the first spindle. A second polishing head having a second spindle extends upward from the base within the chamber and has a polishing material disposed about the second spindle. At least one motor is disposed in the base and is configured to rotate the polishing heads about vertical axes of rotation defined by the spindles. The polishing heads may simultaneously polish internal and external surfaces of the glassware when the first polishing heads are rotated by the at least one motor.

19 Claims, 20 Drawing Sheets

GLASSWARE POLISHING SYSTEM

CROSS-REFERENCE TO RELATED APPLICATIONS

This application claims priority under 35 U.S.C. §119(e) to U.S. Provisional Patent No. Ser. No. 63/045,450, titled "GLASSWARE POLISHING SYSTEM," filed Jun. 29, 2020, which is incorporated herein in its entirety for all purposes.

BACKGROUND

Washing of glassware in conventional dishwashers may sometimes leave marks such as water spots or lipstick on glassware. These marks are undesirable as they can lead to customer dissatisfaction and a loss of reputation at dining establishments should glassware having such marks be presented to customers or embarrassment to dinner party hosts who present glassware having such marks to dinner guests.

SUMMARY

In accordance with one aspect, there is provided a glassware polishing system. The system comprises a base, a wall extending upward from the base, the wall circumscribing and defining a chamber within an inner side of the wall, a first polishing head having a first spindle extending upward from the base within the chamber and having a polishing material disposed about the first spindle, a second polishing head having a second spindle extending upward from the base within the chamber and having a polishing material disposed about the second spindle, and at least one motor disposed in the base and configured to rotate the first polishing head about a first vertical axis of rotation defined by the first spindle and to rotate the second polishing head about a second vertical axis of rotation defined by the second spindle, the first polishing head and second polishing head arranged in a manner to simultaneously polish internal and external surfaces of the glassware when the first polishing head and second polishing head are rotated by the at least one motor.

In some embodiments, the system further comprises a power supply disposed in the base and operable to supply electrical power to the at least one motor. The power supply may include a rechargeable battery. The power supply may be configured to provide amounts of power to the at least one motor to cause the at least one motor to operate at one of multiple available speeds selectable by a user of the system.

In some embodiments, the first polishing head has a diameter different from a diameter of the second polishing head.

In some embodiments, the polishing material of each of the first polishing head and the second polishing head includes strips or fibers of fabric. The strips or fibers of fabric may include an antimicrobial agent. The antimicrobial agent may include silver.

In some embodiments, the wall includes a lower end removably coupled to an upper portion of the base.

In some embodiments, the wall includes an upper end defining a channel configured to provide for insertion of one of a base of glassware or a portion of an item of silverware into the chamber.

In some embodiments, the base includes an upper wall defining a bottom of the chamber and air flow channels passing through the upper wall.

In some embodiments, the system further comprises a handle coupled to the base and removably coupled to a channel or detent in an outer side of the wall.

In some embodiments, the first polishing head and the second polishing head are each removably coupled to a respective shaft of the at least one motor.

In some embodiments, the system further comprises an insert formed of a compliant material disposed on the inner side of the wall. The insert may include a bead disposed on an upper edge of the wall. The insert may be removable and replaceable.

In some embodiments, one of the wall or the handle includes labelling.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1A:
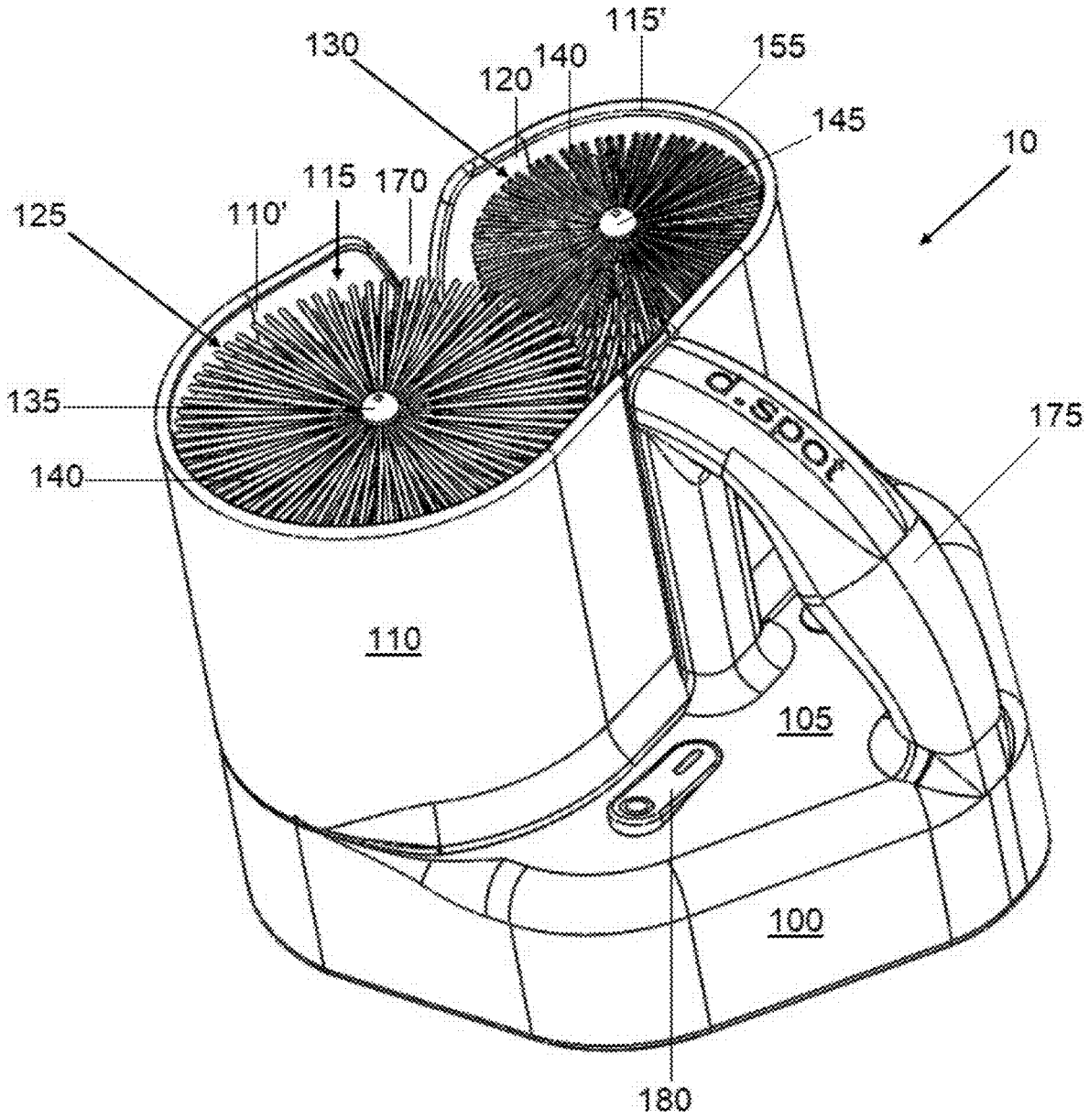
FIG. 1A is an isometric view from the front of an embodiment of a glassware polishing system.

The disclosure is not limited in its application to the details of construction and the arrangement of components set forth in the following description or illustrated in the drawings. The disclosure is capable of other examples and of being practiced or of being carried out in various ways. Also, the phraseology and terminology used herein is for the purpose of description and should not be regarded as limiting. The use of "including," "comprising," "having," "containing," "involving," and variations thereof herein is meant to encompass the items listed thereafter and equivalents thereof as well as additional terms.

Aspects and embodiments disclosed herein are generally directed to a glassware polishing system and methods for use of same. The glassware polishing system includes a base and a pair of polishing heads extending upward from an upper surface of the base. One or more motors disposed in the base have shafts releasably mechanically coupled to spindles of the pair of polishing heads. The one or more motors are driven by an electrical power source (a battery or a wired power source) disposed in the base to rotate the polishing heads about their vertical axes. One may place the internal cup portion of an item of glassware over a first of the polishing heads. The first polishing head will polish the inside surface of the item of glassware and remove spots that may be present. The second polishing head may be positioned sufficiently close to the first polishing head such that it contacts an outer surface of the item of glassware placed over the first polishing head and polishes the outside surface of the item of glassware. The polishing heads may have different diameters to accommodate glassware of different sizes. The polishing heads may be removable and replaceable in the base to allow for replacement with other polishing heads having diameters appropriate for different types of glassware.

Figure 1B:
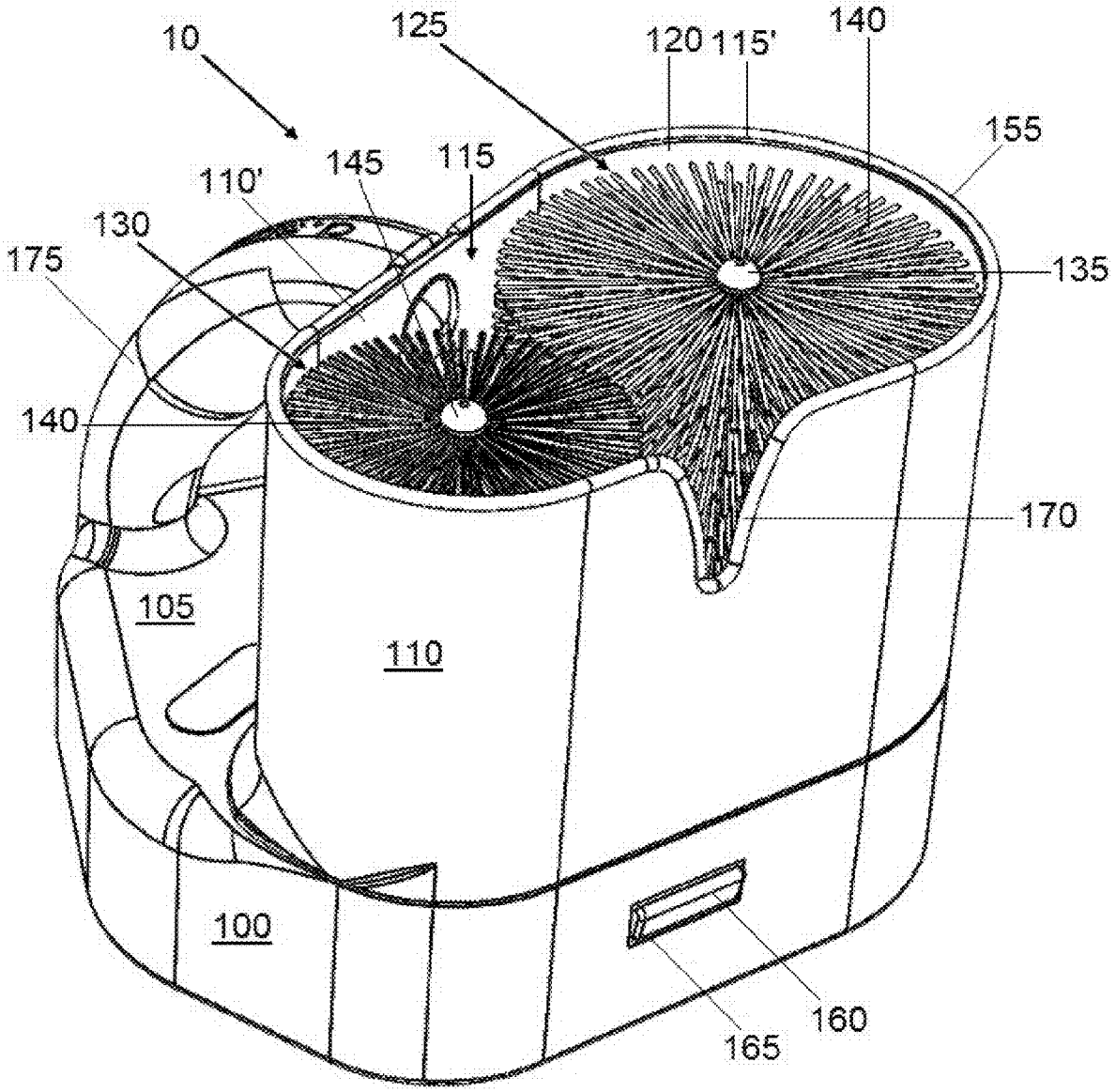
FIG. 1B is an isometric view from the rear of the glassware polishing system of FIG. 1A.

An embodiment of a glassware polishing system in accordance with the present disclosure is illustrated in isometric views from the front and rear, respectively, in FIGS. 1A and 1B. The glassware polishing system, indicated generally at 10, includes a base 100. Attached to and extending upward from an upper surface 105 of the base 100 is a wall 110. The wall 110 circumscribes and defines a chamber 115 within an inner surface 120 of the wall 110. The chamber 115 has an open upper end 115'. Within the chamber 115 are disposed two polishing heads 125, 130. A first of the polishing heads 125 includes a first spindle 135 extending along a vertical axis of rotation of the first polishing head 125. Attached to the first spindle 135 and radiating radially outward from the first spindle 135 about a perimeter of the first spindle 135 is a polishing material 140. The polishing material 140 may be in the form of strips of a fabric or fibers. The polishing material 140 may include, for example, strips or fibers of microfiber or another suitable fabric. In some embodiments, the polishing material 140 may include an antimicrobial agent, for example, silver fibers or silver coated threads that will help reduce or prevent the growth of bacteria in the polishing material 140. The second of the polishing heads 130 includes a second spindle 145 extending along a vertical axis of rotation of the second polishing head 130. Attached to the second spindle 145 and radiating radially outward from the second spindle 145 about a perimeter of the second spindle 145 is a polishing material 140 which may be substantially the same or the same as the polishing material 140 of the first polishing head 125.

The first and second polishing heads 125, 130 may be of substantially the same height. The first polishing head 125 may have a radius, defined by the length by which the polishing material 140 attached to the first spindle 135 extends from the first spindle 135, that is greater than a radius of the second polishing head 130 defined by the length by which the polishing material 140 attached to the second spindle 145 extends from the second spindle 145. In one non-limiting example, the first and second spindles 135, 145 may be spaced about three inches apart. The first polishing head 125 may have a diameter of about 4.5 inches while the second polishing head 130 may have a diameter of about 1.75 inches. The first and second spindles 135, 145 of the respective first and second polishing heads 125, 130 may be laterally offset from one another within the chamber 115 by about the sum of their respective radii. In some embodiments the polishing material 140 of the two polishing heads 125, 130 may not make contact, but in other embodiments, may overlap by a small distance, for example, to have an overlap region of from about 0.75 cm to about 1.5 cm or of about 1 cm in maximum length in a direction from the first spindle 135 toward the second spindle 145.

The chamber 115 may further include an insert 150 formed of a compliant material, for example, silicone or another soft polymer. The insert 150 may cover the interior surface 110' of the wall 110 and may form a bead 155 disposed on a top lip of the wall 110 defined by the open upper end 115' of the chamber 115. The insert 150 may help prevent breakage of glassware that is introduced into the chamber 115 and that may contact the wall 110 of the glassware polishing system 10. In some embodiments, the insert 150 is removable from the wall 110 and may be washed and reinstalled on the wall 110.

In some embodiments, the wall 110 is removably secureable or secured to the base 105. The wall 110 may include, for example, one or more tabs 160 that engage one or more slots or openings 165 in a wall of the base 105. Exerting pressure on the one or more tabs 160 may move them out of engagement with the one or more slots or openings 165 to allow for the wall 110 to be separated from the base 105. One may wish to separate the wall 110 from the base 105 for replacement or cleaning, or to allow for polishing of glassware that does not fit within the chamber 115 defined by the wall 110.

A channel portion 170 may be defined in the upper edge of the wall 100. As is explained in further detail below, the channel portion 170 may allow one to introduce bases or stems of glassware into the chamber 115 from the side for polishing.

The glassware polishing system 10 may include a handle 175 coupled to the base 100, for example, extending upward from the upper surface 105 of the base 100. In some embodiments, the handle 175 may come into close proximity with or may contact an outer side of the wall 110 but may be free of fixed mechanical coupling to the wall 110. This may allow for the wall 110 to be removed from the base 100 and handle 175 as described above.

A power switch 180 may be included on an outer surface of the glassware polishing system 10, for example, on the upper surface 105 of the base 100 as illustrated in FIG. 1A. In other embodiments, the power switch 180 may be disposed on other portions of the glassware polishing system 10, for example, on the handle 175. Closing the power switch 180 may cause an electrical motor or motors disposed within the base 100 to rotate and drive the first and second spindles 135, 145 to cause the polishing heads 125, 130 to rotate about their vertical rotational axes. An item of glassware having an internal portion placed on the first polishing head 125 may be polished on its inside by the polishing material 140 of the first polishing head 125 and polished on its outside by the polishing material 140 of the second polishing head 130. An item of glassware having an internal portion placed on the second polishing head 130 may be polished on its inside by the polishing material 140 of the second polishing head 130 and polished on its outside by the polishing material 140 of the first polishing head 125. Closure of the power switch 180 may cause the motor(s) to drive the polishing heads 125, 130 in the same rotational directions, for example, clockwise or counterclockwise when viewed from above, or, alternatively or selectively, in opposite rotational directions relative to one another. The power switch 180 may have multiple settings that, when selected from, cause the motor(s) to drive the polishing heads 125, 130 at different speeds, for example at five different speeds. In some examples, the rotational speeds of the polishing heads 125, 130 may be selected to move at any suitable speed, for example, the rotational speeds of the polishing heads 125, 130 may range from about 1500 to about 1800 rounds per minute (RPM), from about 1000 to about 3000 RPM, or from about 500 to about 6000 RPM. The power switch 180 may be a rocker switch as illustrated in FIG. 1A or may alternatively be a dial switch or potentiometer or any other form of electrical switch known in the art.

Figure 2A:
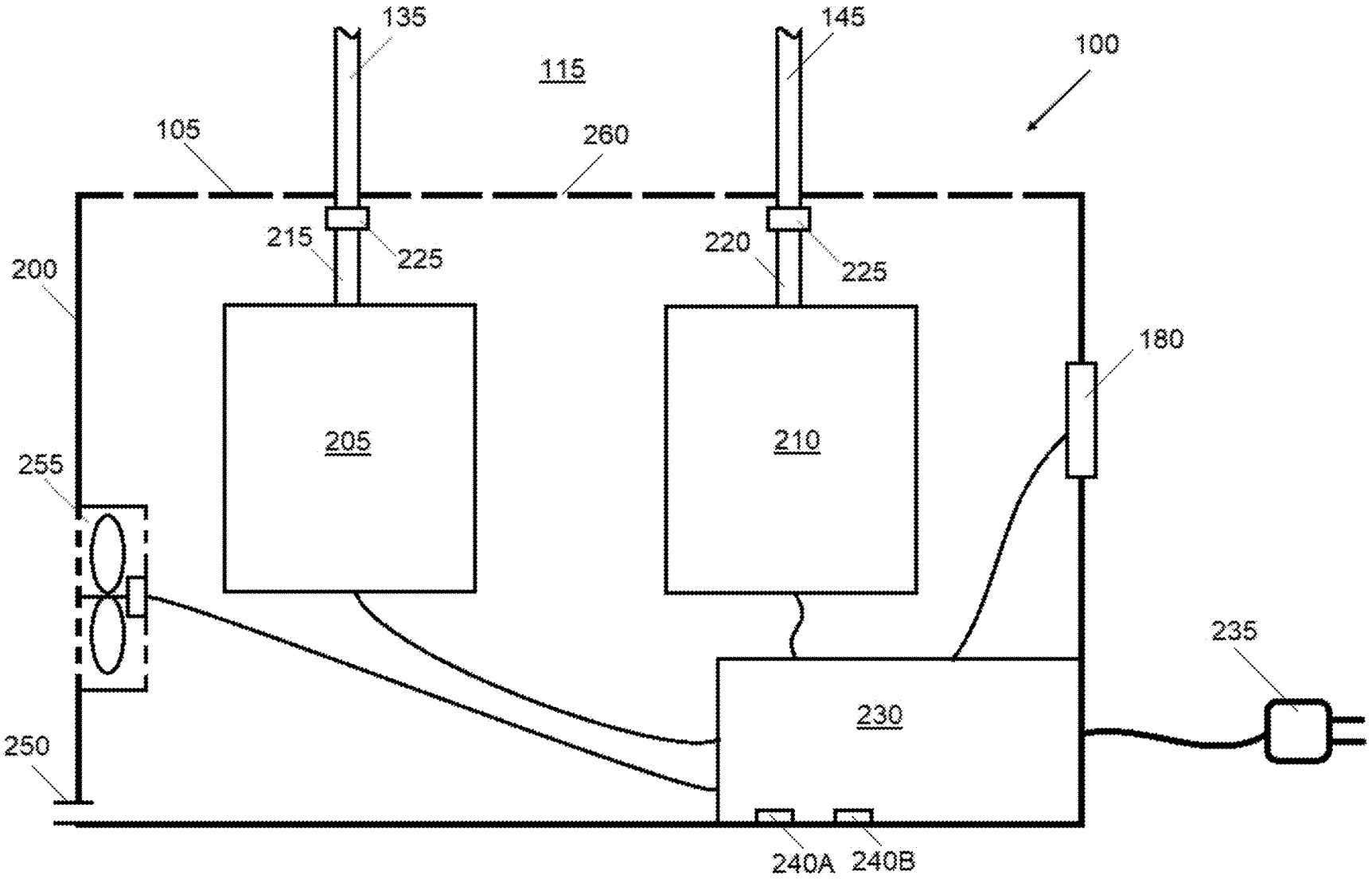
FIG. 2A is a schematic illustration of one embodiment of a base of a glassware polishing system.
Figure 2B:
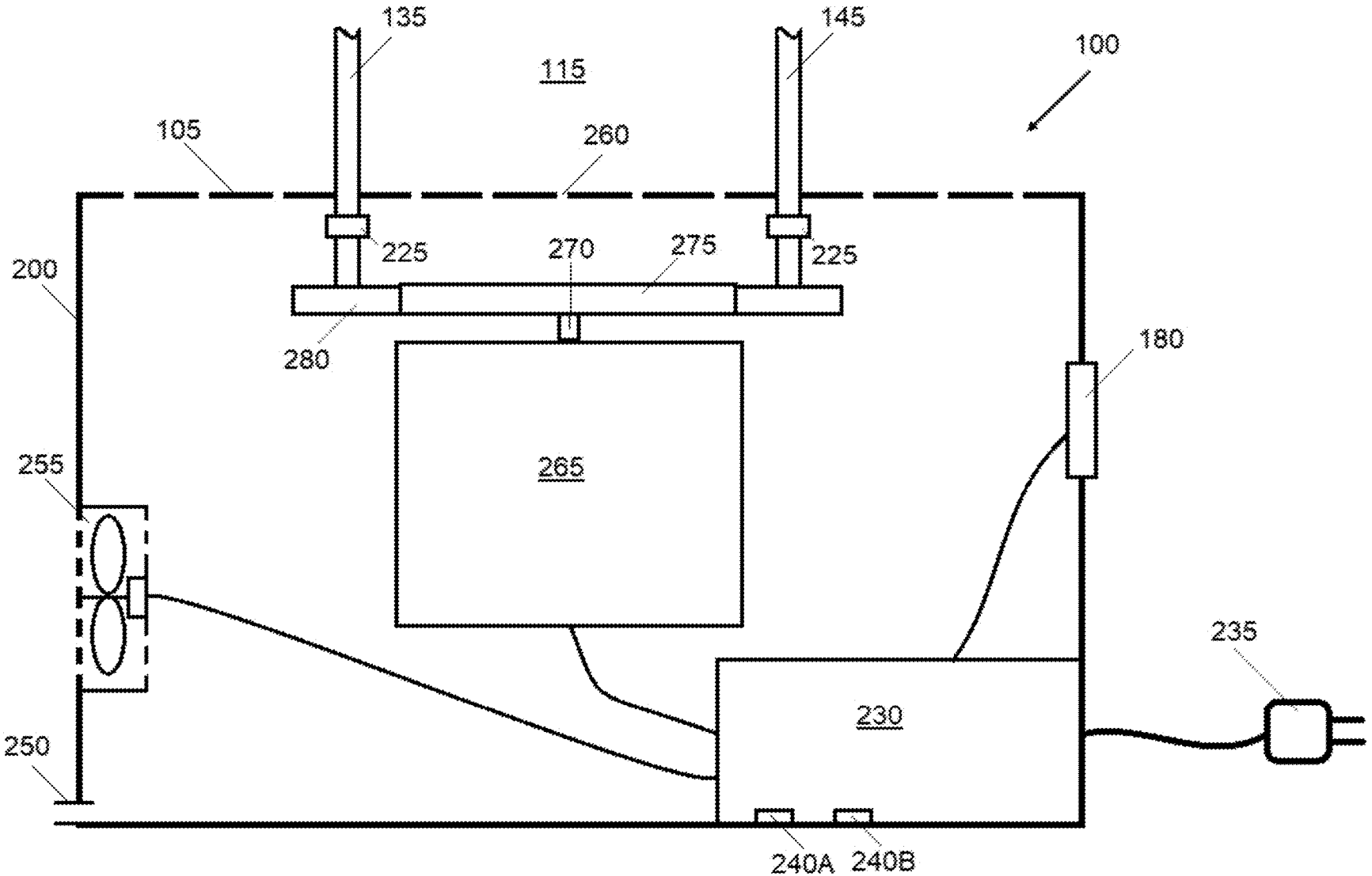
FIG. 2B is a schematic illustration of another embodiment of a base of a glassware polishing system.
Figure 2C:
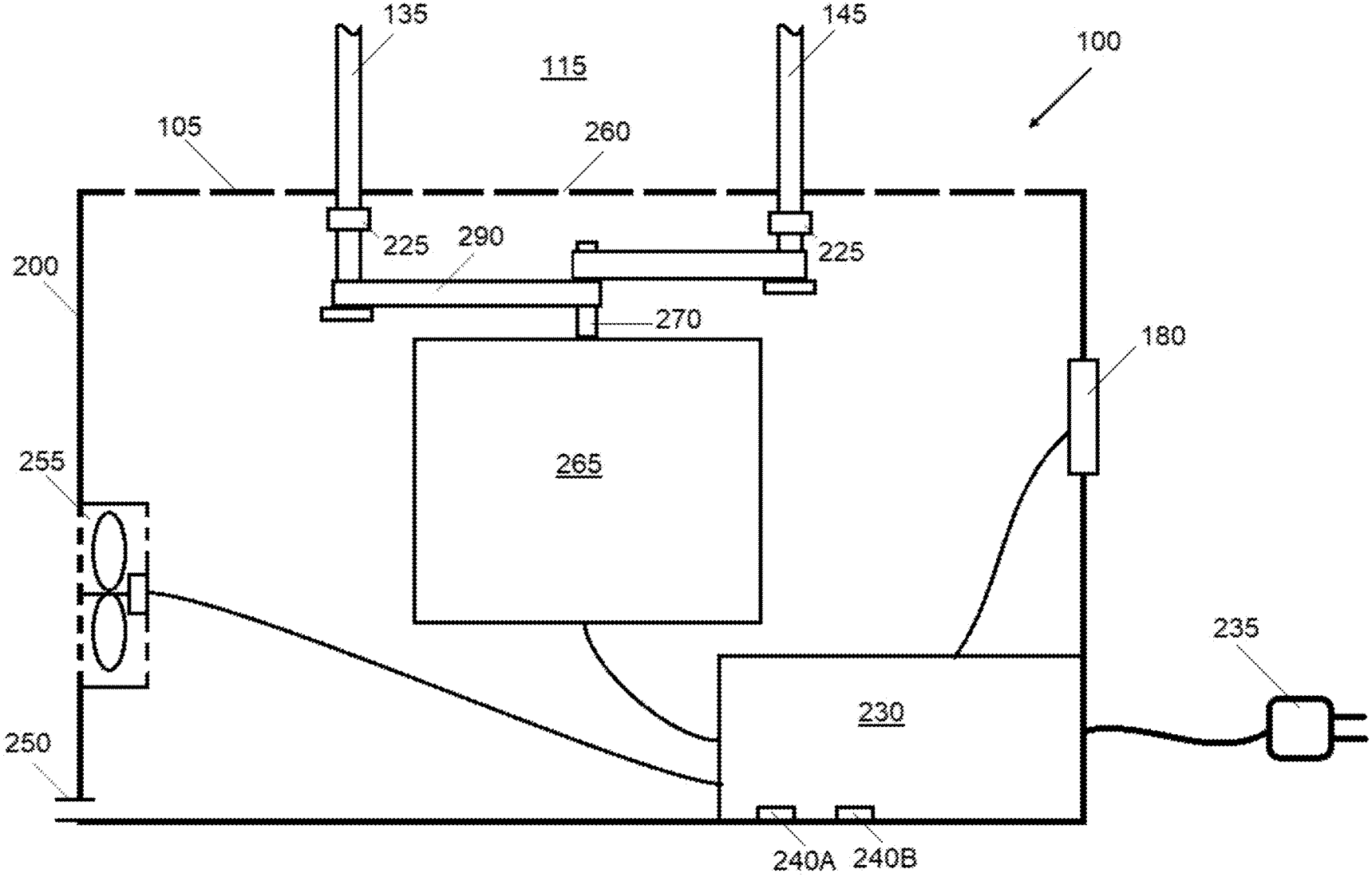
FIG. 2C is a schematic illustration of another embodiment of a base of a glassware polishing system.

Components internal to embodiments of the base 100 are illustrated schematically in FIGS. 2A-2C. The base 100 includes a housing 200 with an upper surface 105 as described above. The spindles 135, 145 of the polishing heads 125, 130 (polishing material 140 omitted for clarity) extend upward from the upper surface 105 of the housing 200 of the base 100 into the chamber 115 (wall 110 omitted for clarity). The spindles 135, 145 are rotationally driven by motors 205, 210 disposed within the housing. Shafts 215, 220 of respective motors 205, 210 are releasably mechanically coupled to the spindles 135, 145 by mechanical couplings 225 that may include, for example, bayonet mounts, snap fittings, or other releasable mechanical couplings known in the art. The mechanical couplings 225 are illustrated within the housing 200 but in other embodiments may be located outside of the housing 200 above the upper surface 105 and within the chamber 115. A power supply 230 is provided within the housing 200 for supplying electrical power to operate the motors 205, 210. The power supply 230 may in some embodiments include a rechargeable battery that may be recharged by power supplied from a mains power supply (not shown) via a plug and cord 235. The rechargeable battery may additionally or alternatively include electrical contacts 240A, 240B that pass through a wall of the housing 200 to contact corresponding electrical contacts of an external charger. In embodiments including a rechargeable battery as the power source 230, the glassware polishing system 10 may be light and portable and may be carried by the handle 175.

In other embodiments, the power supply 230 does not include a rechargeable battery but receives power via the plug and cord 235 and transforms the incoming power into a form suitable for driving the motors 205, 210. The switch 280, illustrated on a side of the housing 200 of the base 100 in FIGS. 2A-2C, is used to control the power supply 230 for delivery of power to the motors 205, 210 to achieve a desired rotational speed or speeds of the spindles 235, 245. In some embodiments, the power supply 230 may supply different amounts of power to the two motors 205, 210 to cause the spindles 235, 245 to rotate at different speeds relative to one another while in other embodiments, the power supply 230 may supply amounts of power to the two motors 205, 210 selected to cause the spindles 235, 245 to rotate at the same speed as each other.

In some embodiments, the housing 200 may include a drain aperture 250 to allow any liquid that makes its way into the housing 200 to be removed. The housing 200 may also include a fan 255 that draws air into the interior of the housing 200 and out through apertures or air flow channels 260 in the upper wall of the housing 220 into the chamber 115 to dry glassware and/or the polishing material 140 of the polishing heads 125, 130 should wet glassware be introduced into the glassware polishing system 10 for polishing. The fan 255 may alternatively be operated to draw air out of the interior of the housing 200 to, for example, remove moisture from the interior of the housing 200 or chamber 115.

In other embodiments, as illustrated in FIGS. 2B and 2C, the housing 200 of the base 100 may include only a single drive motor 265 that may transfer motive force from its shaft 270 to the spindles 135, 145 of the polishing heads 125, 130 via one or more gears 275, 280 (FIG. 2B) or belts 290 (FIG. 2C). The provision of a single motor 265 to drive both spindles 135, 145 may make the glassware polishing system 10 lighter than a comparable glassware polishing system 10 having two drive motors 205, 210 for the respective spindles 135, 145, but at a cost of having less control over the relative speed of rotation of the different polishing heads 125, 130.

In some embodiments, the fan 255 may be omitted and during operation, heat generated by the motors 205, 210, or motor 265 disposed in the base may cause warm or hot air to pass upward through the apertures or air flow channels 260. The heated air may dry glassware disposed in the chamber 115, the polishing material 140 of the polishing heads 125, 130, and/or the wall 110 or other features within the chamber 115. The flow of warm air upward through the chamber 115 from the apertures or air flow channels 260 blow loose dust, debris, or lint from out of the chamber 115.

Figure 3:
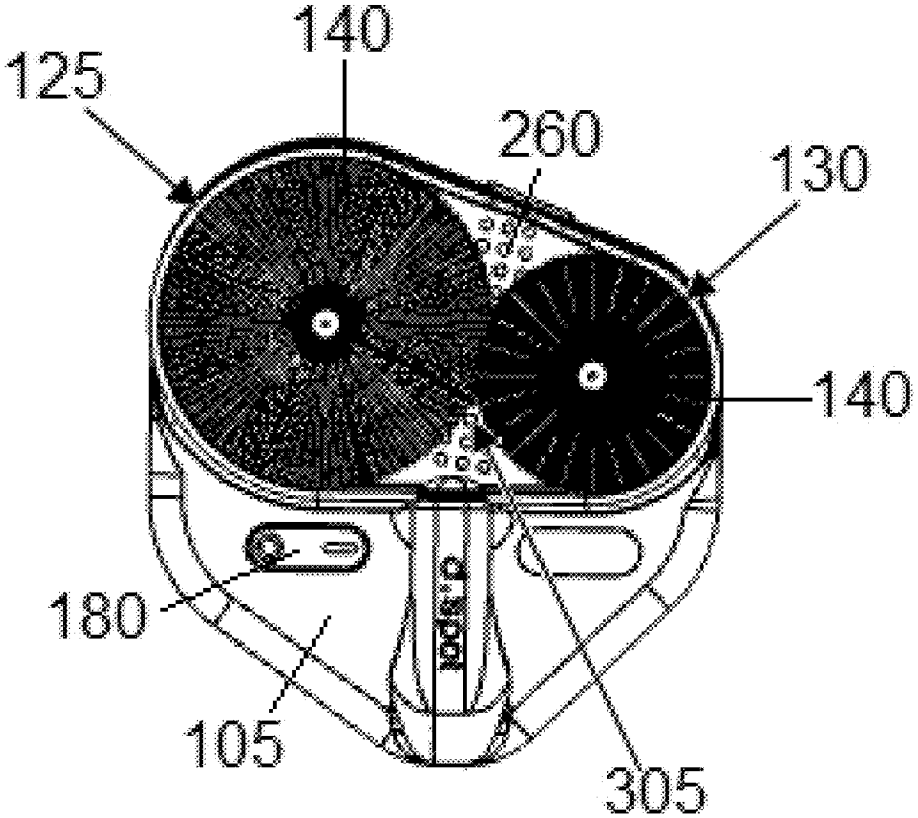
FIG. 3 is a plan view from the top of an embodiment of a glassware polishing system.

A view of the glassware polishing system 10 from the top down is provided in FIG. 3. Visible in FIG. 3 is a region of overlap 305 between the polishing material 140 of the first and second polishing heads 125, 130. Also visible are the apertures or air flow channels 260 passing through the upper surface 105 of the housing 200 of the base 100.

Figure 4:
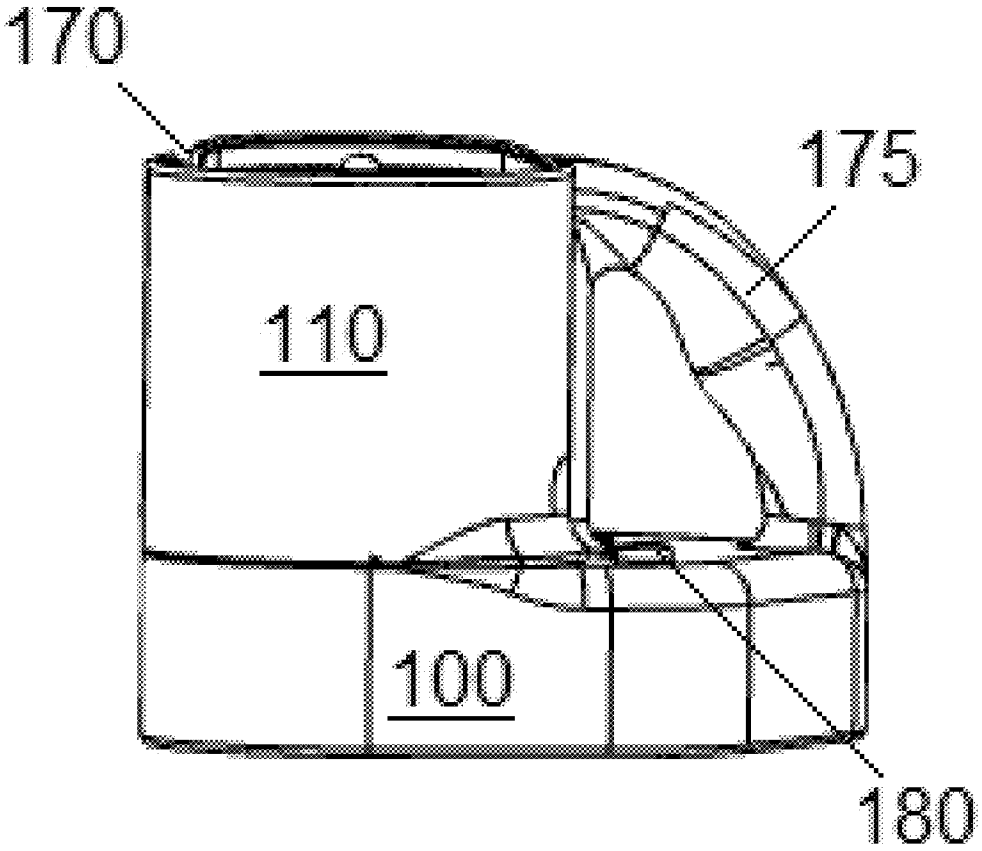
FIG. 4 is an elevational view from the left of an embodiment of a glassware polishing system.
Figure 5:
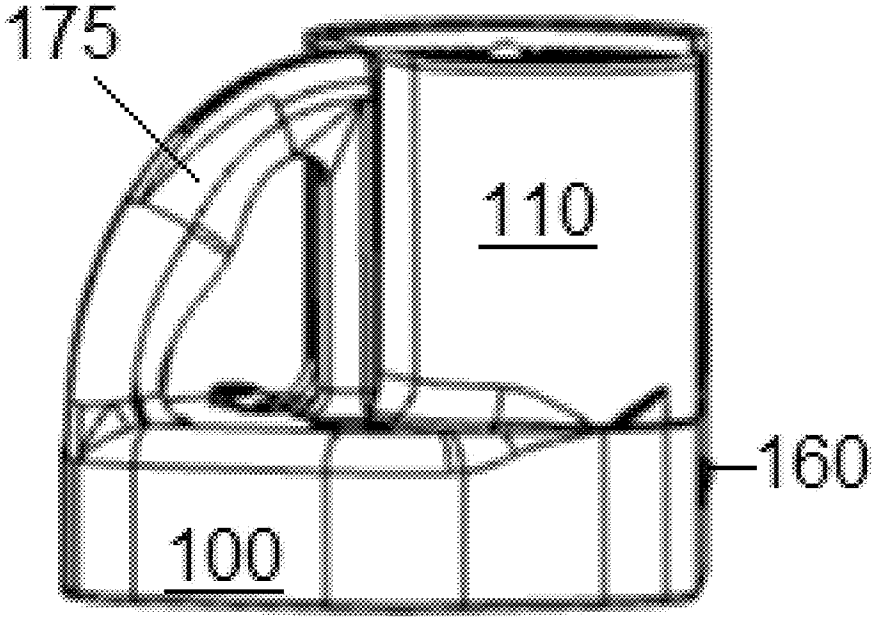
FIG. 5 is an elevational view from the right of an embodiment of a glassware polishing system.
Figure 6:
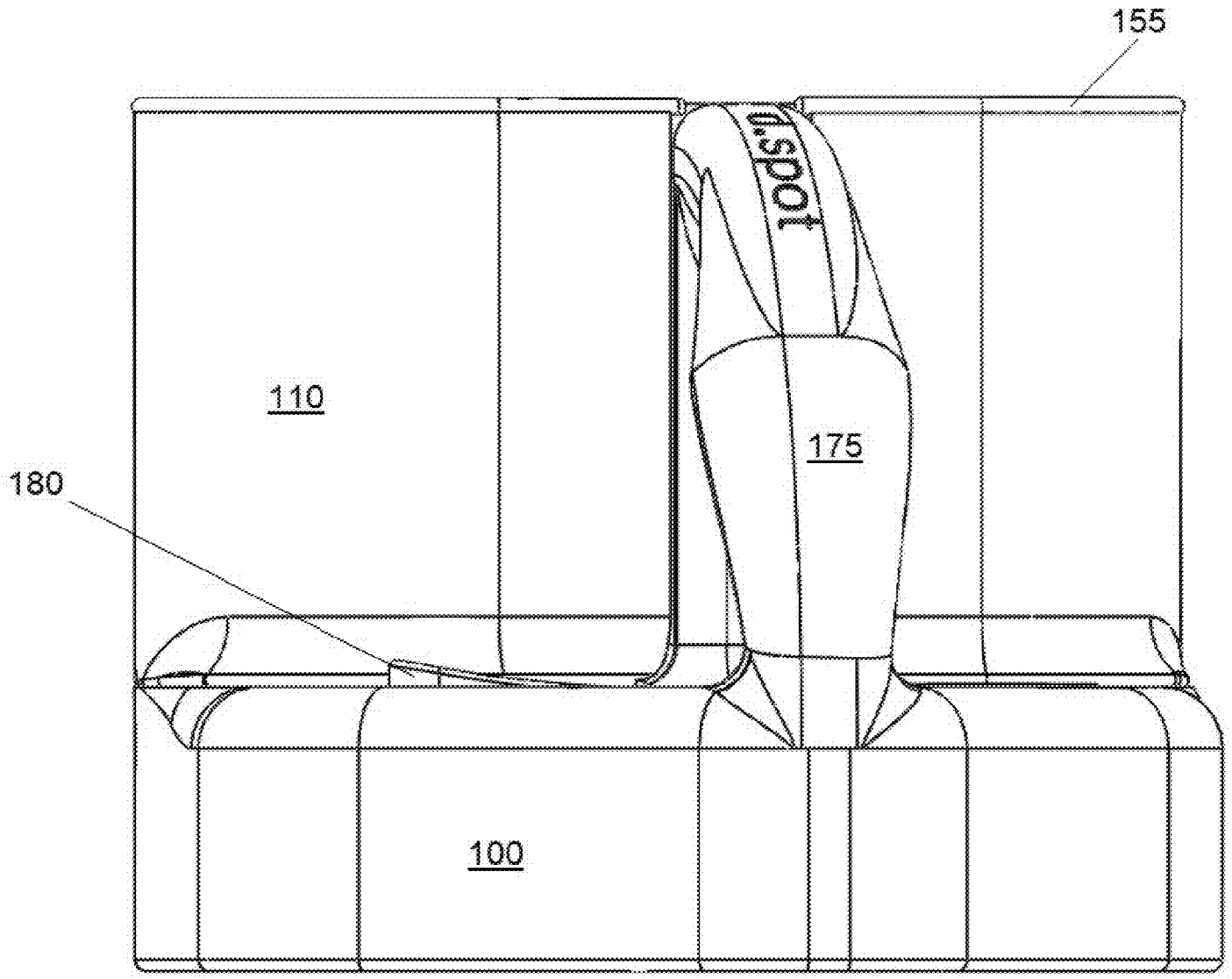
FIG. 6 is an elevational view from the front of an embodiment of a glassware polishing system.
Figure 7:
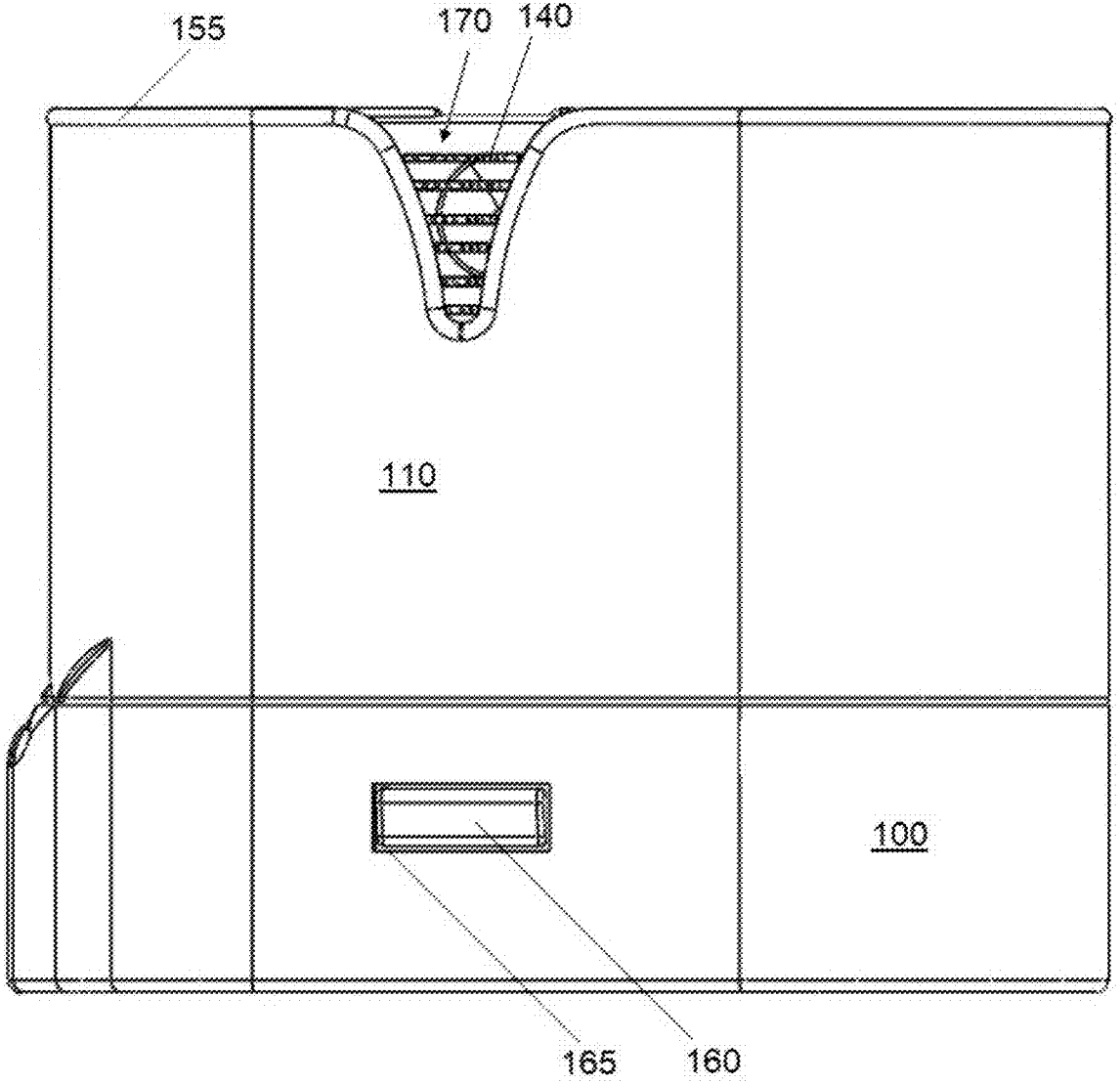
FIG. 7 is an elevational view from the rear of an embodiment of a glassware polishing system.
Figure 8:
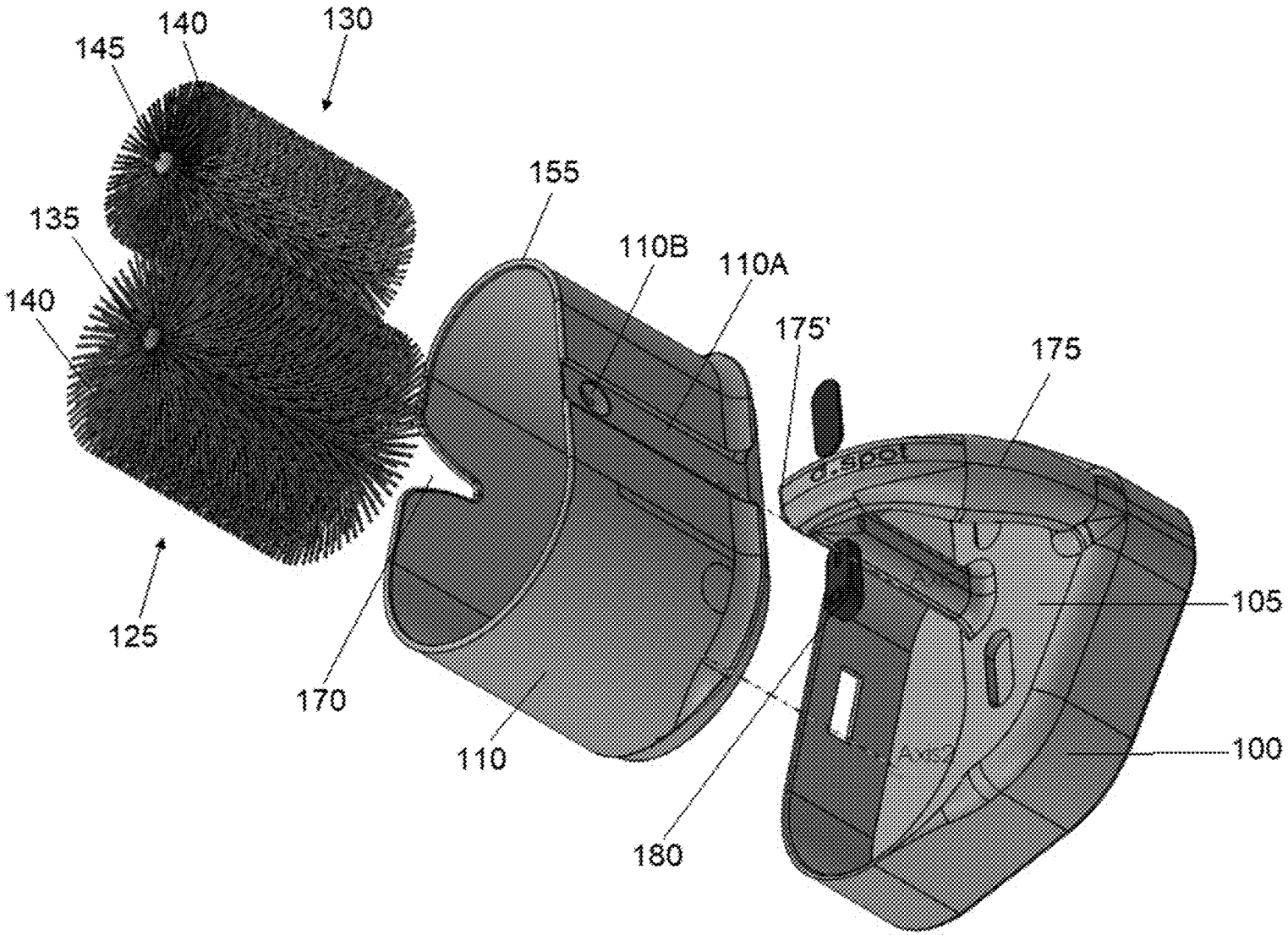
FIG. 8 is an exploded view of an embodiment of a glassware polishing system.

Views of the glassware polishing system 10 from the left and right are provided in FIGS. 4 and 5, respectively. Views of the glassware polishing system 10 from the front and back are provided in FIGS. 6 and 7, respectively, and in an exploded view in FIG. 8. As illustrated in the exploded view of FIG. 8, in some embodiments, the wall 110 may include a recess 110A to releasably receive a vertically oriented portion of the handle 175. The wall 110 may also include a detent 110B to releasably receive an upper end portion 175' of the handle 175. The recess 110A and detent 110B may help stabilize the handle 175 relative to the wall 110 when the glassware polishing system 10 is assembled or operated.

Figure 9:
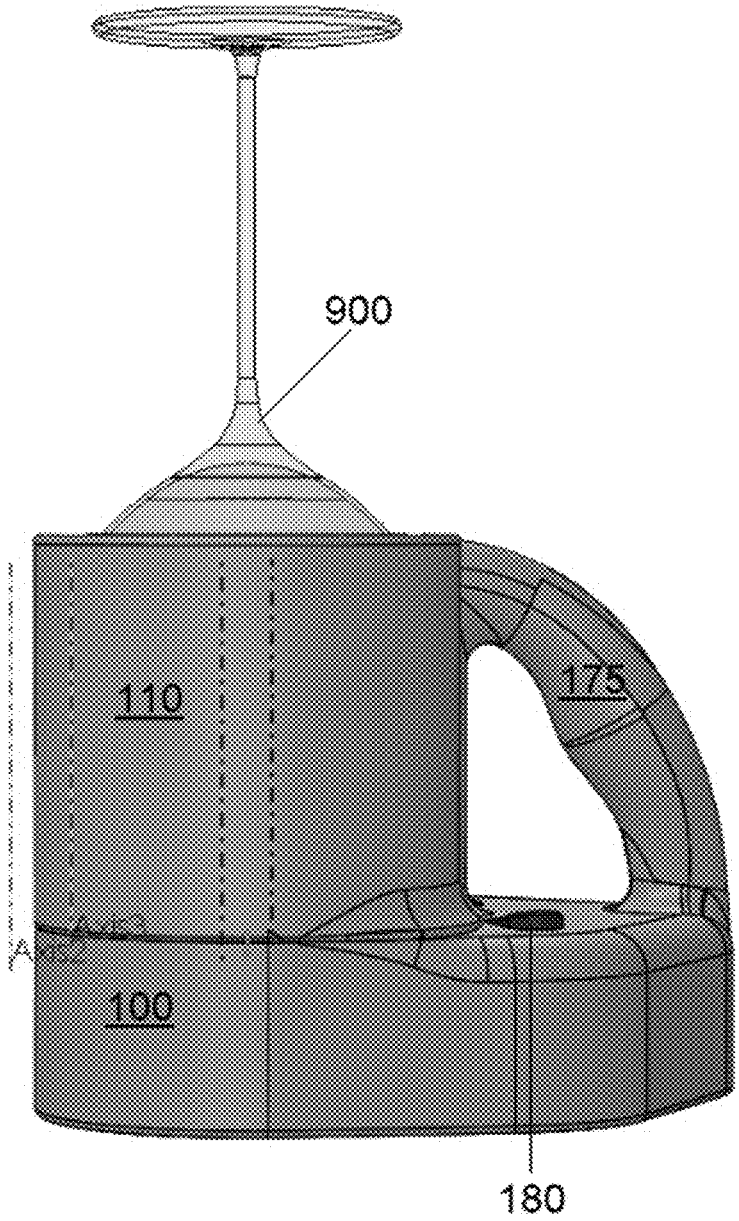
FIG. 9 is an elevational view from the left of an embodiment of a glassware polishing system polishing an item of glassware.
Figure 10:
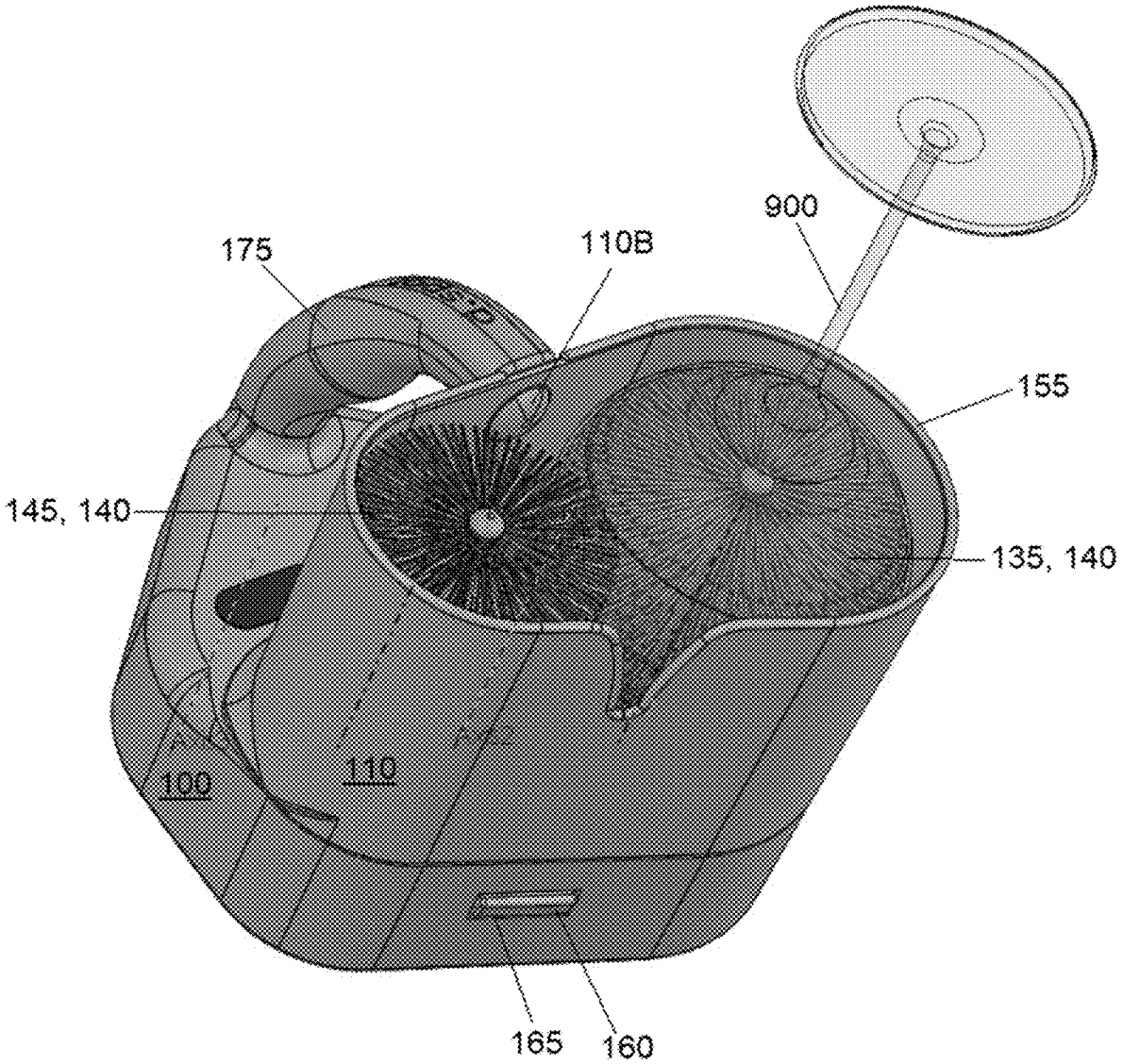
FIG. 10 is an isometric view of an embodiment of a glassware polishing system polishing an item of glassware.
Figure 11:
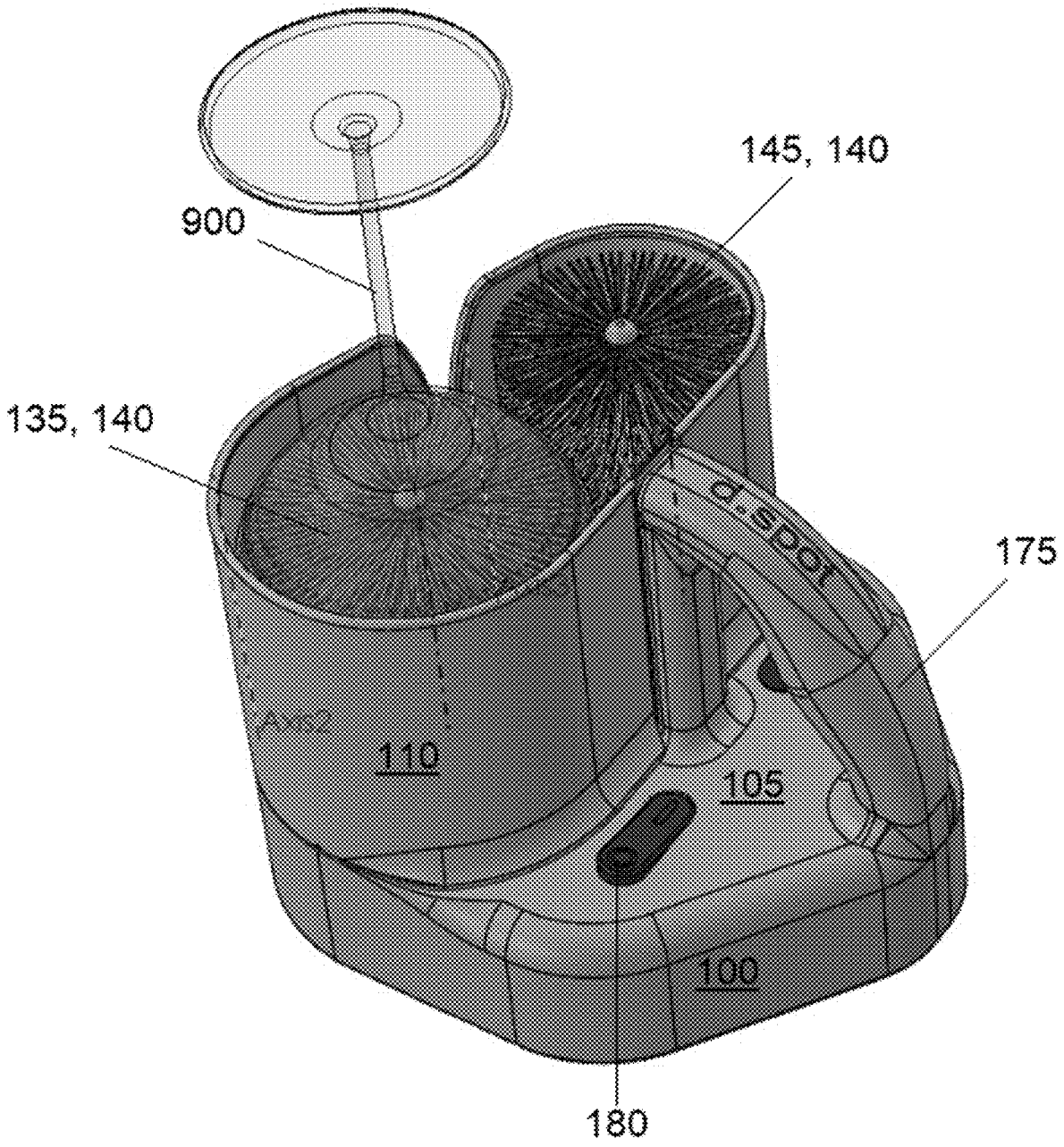
FIG. 11 is another isometric view of an embodiment of a glassware polishing system polishing an item of glassware.

FIGS. 9-12 illustrate how one might utilize the glassware polishing system 10 to polish an item of glassware. As illustrated in FIGS. 9-11 one may place the mouth of an item of glassware 900, for example, a wine glass over one of the polishing heads 125, 130. One may select the polishing head 125, 130 with a diameter closest to the internal diameter of the item of glassware 900 to place the item of glassware 900 over. After the item of glassware 900 is placed over the selected polishing head 125 as illustrated, or alternatively, while placing the item of glassware 900 on the selected polishing head 125, one may activate the switch 180 to cause the polishing heads 125, 130 to start rotating. The polishing material of the selected polishing head 125 polishes the inside of the item of glassware 900, while the polishing material 140 of the other polishing head 130 polishes the outside surface of the item of glassware 900. One may rotate the item of glassware 900 so that the polishing material 140 of the polishing head 130 makes contact with and polishes all of the external surface of the item of glassware 900. In some embodiments, one may start to polish the item of glassware 900 with the polishing heads 125, 130 rotating at a first lower speed and may increase the speed of rotation of the polishing heads 125, 130, using the switch 180, if spots are not removed to a desired degree when operating the glassware polishing system 10 with the polishing heads 125, 130 rotating at the first lower speed. When the item of glassware has been polished to a desired degree one may stop the rotation of the polishing heads 125, 130 by manipulation of the switch 180 and remove the item of glassware from the chamber 115.

Figure 12:
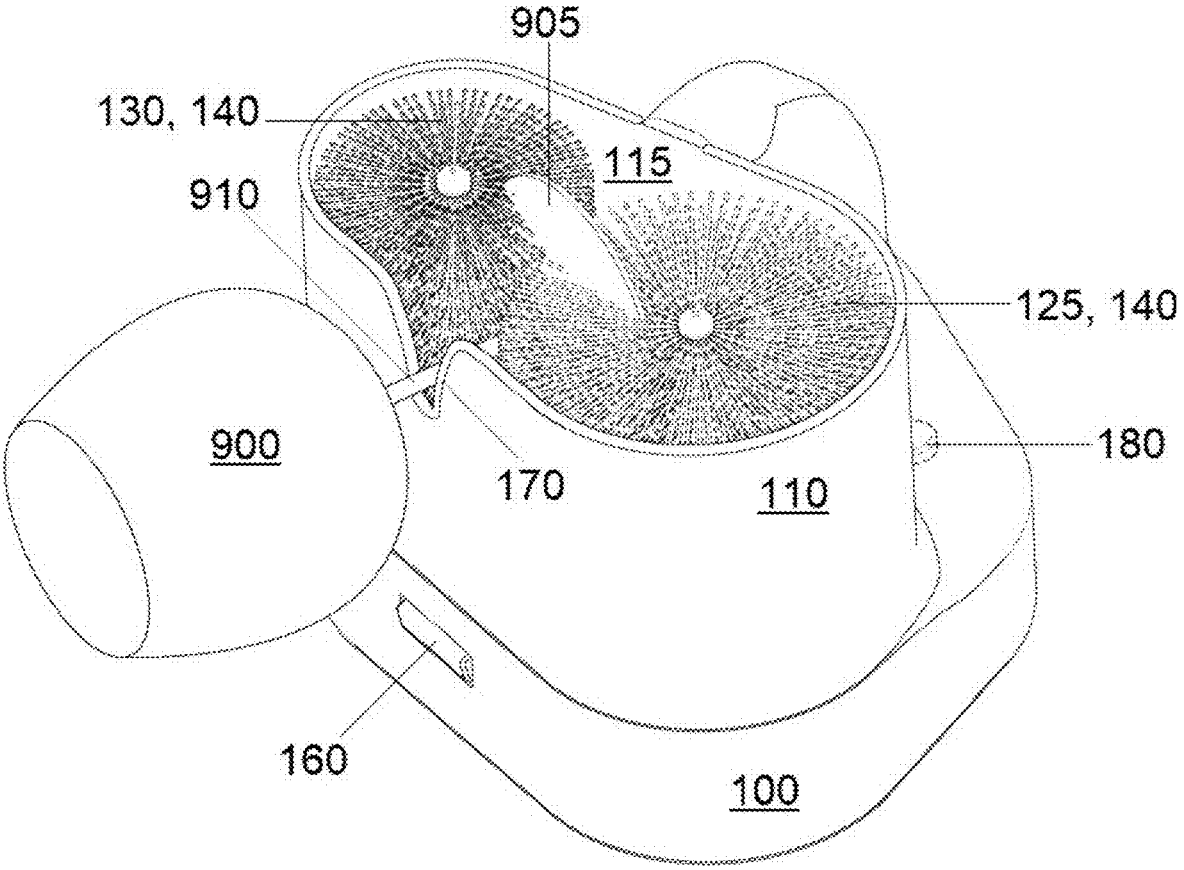
FIG. 12 is a view of an embodiment of a glassware polishing system polishing a base of an item of glassware.

As illustrated in FIG. 12, if one wishes to polish the base 905 and/or stem 910 of an item of glassware 900, one may insert the base or stem into the chamber 115 through the channel portion 170 and use the switch 180 to cause the polishing heads 125, 130 to rotate until the base or stem is polished by the polishing material 140 to a desired degree.

Figure 13A:
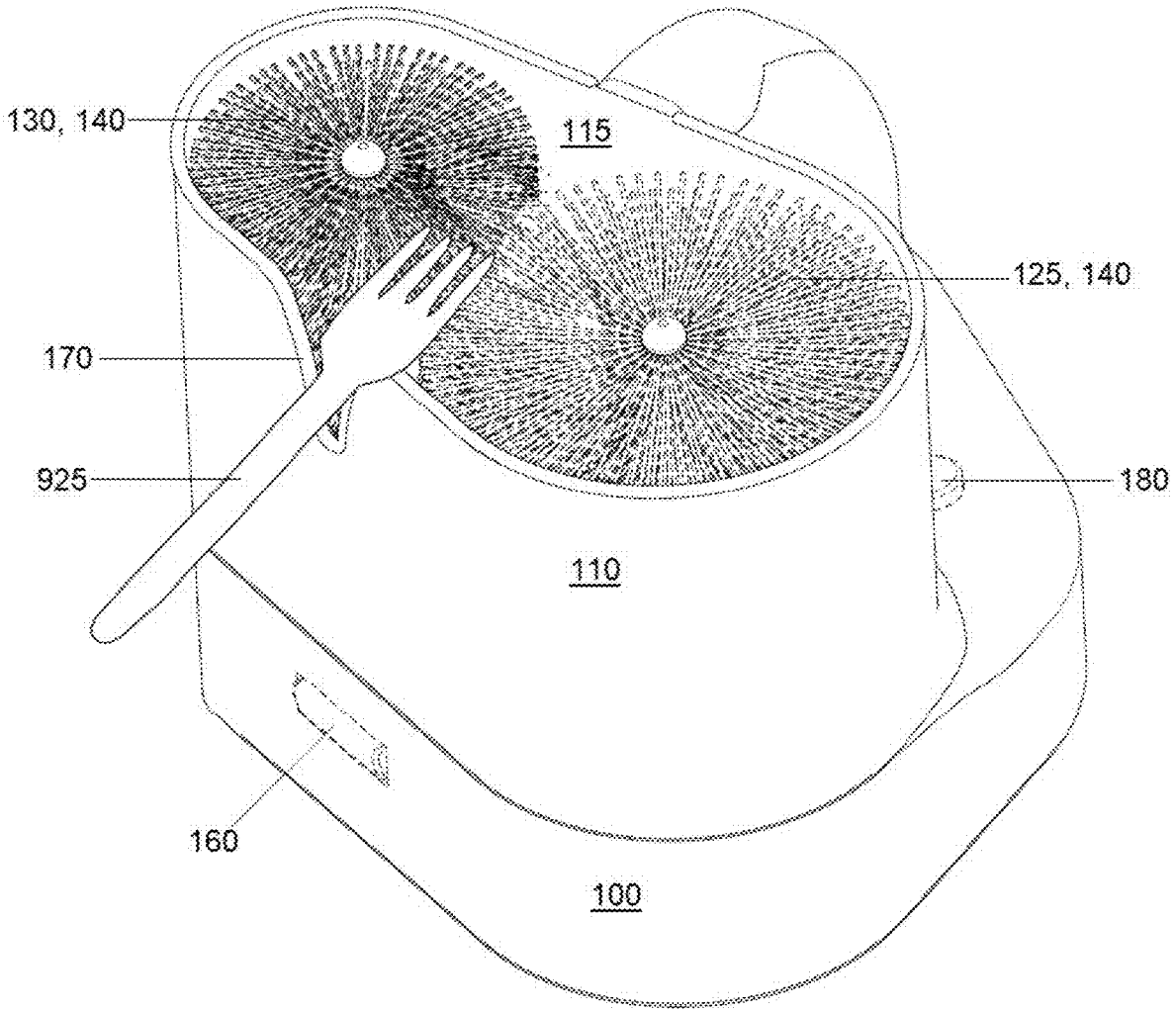
FIGS. 13A and 13B are views of an embodiment of a glassware polishing system polishing items of silverware.
Figure 13B:
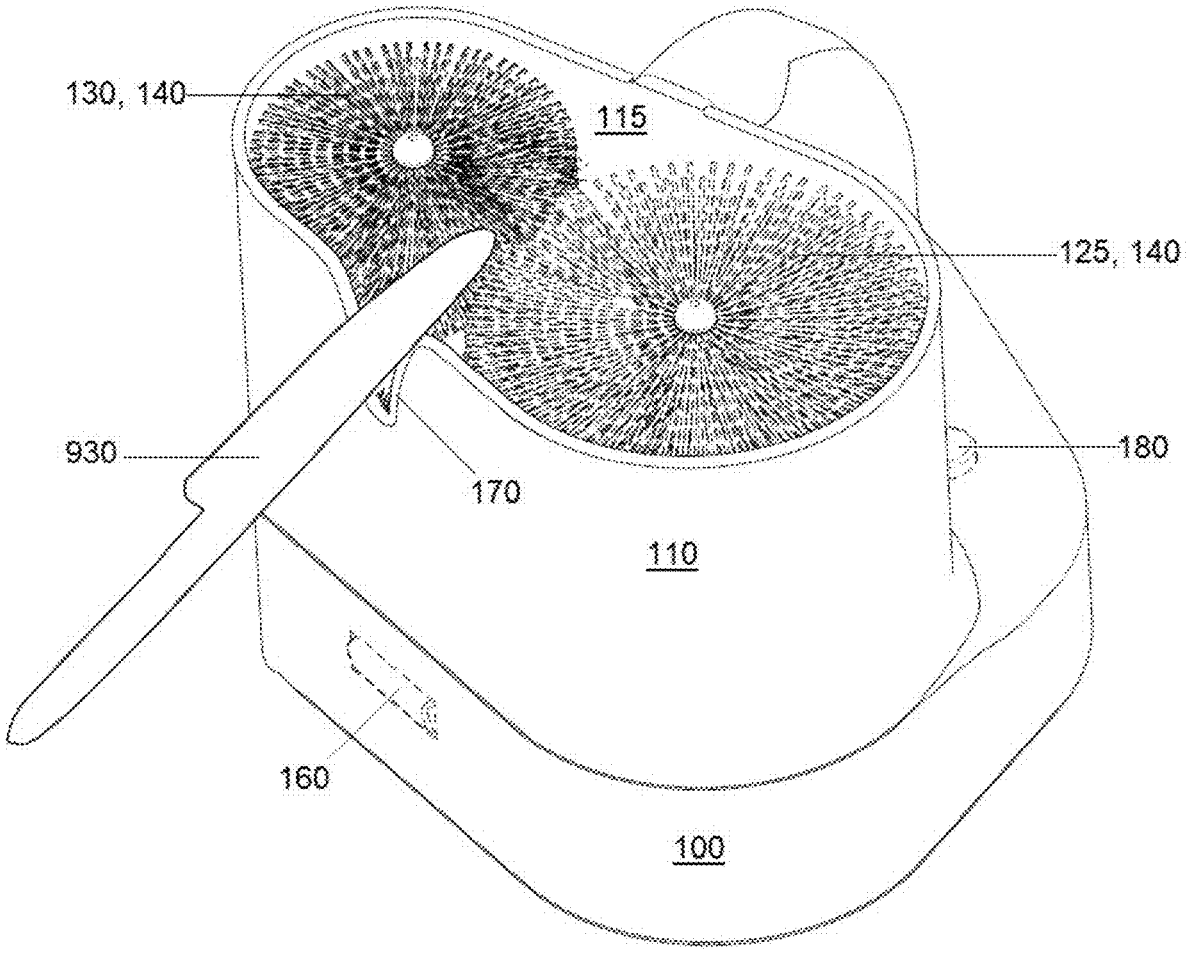

In further embodiments, the glassware polishing system 10 may be utilized to polish items of silverware, for example, forks, knives, or spoons. In a similar manner in which one may polish the base 905 and/or stem 910 of an item of glassware 900 as illustrated in FIG. 12, one may insert a portion of an item of silverware, for example, a fork 925 (FIG. 13A) or a knife 930 (FIG. 13B) into the chamber 115 of the glassware polishing system 10 through the channel portion 170. One may then use the switch 180 to cause the polishing heads 125, 130 to rotate until the item of silverware is polished by the polishing material 140 to a desired degree.

It is to be appreciated that embodiments of a glassware polishing system as disclosed herein may be customizable for different users by the application of labelling including, for example, logos, names, text, etc. to outer portions of the base 100, wall 110, or handle 175. For example, if a restaurant was to use glassware polishing systems as disclosed herein the logo or name of the restaurant could be printed or otherwise included on one or more portions of the systems. If one were to gift a glassware polishing system as disclosed herein to someone, one may have the name or other identifier of the gift recipient printed or otherwise included in one or more portions of the glassware polishing system.

Aspects and embodiments of the glassware polishing system 10 have been described and illustrated herein as including two polishing heads 125, 130 having different diameters. In other embodiments, the polishing heads 135, 130 may have similar or the same dimensions or more than two polishing heads may be present. The provision of more than two polishing heads may provide for more than one item of glassware to be polished at a time in the system.

Figure 14A:
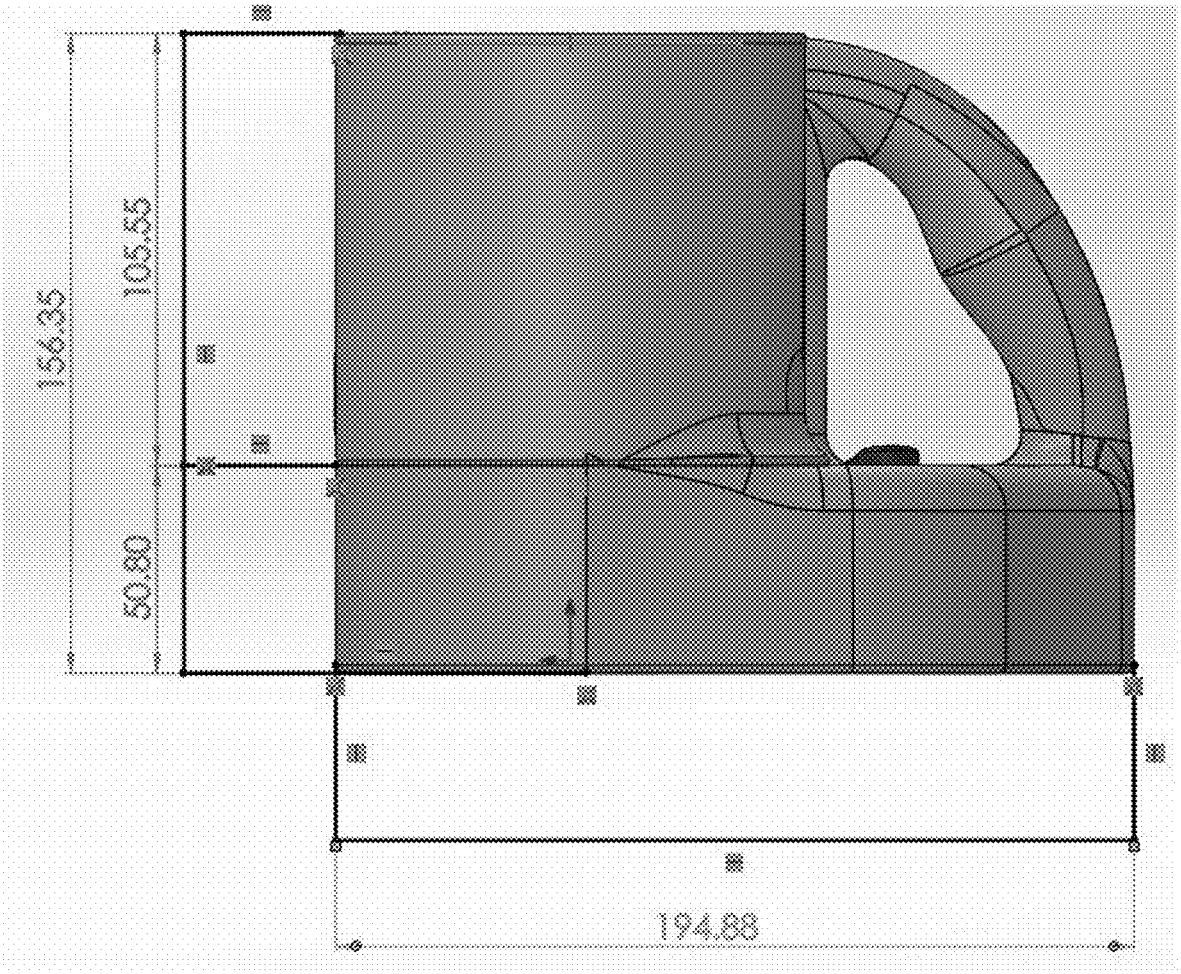
FIGS. 14A-14C are views from the side, front, and top, respectively, illustrating the dimensions of one example of a glassware polishing system as disclosed herein.
Figure 14B:
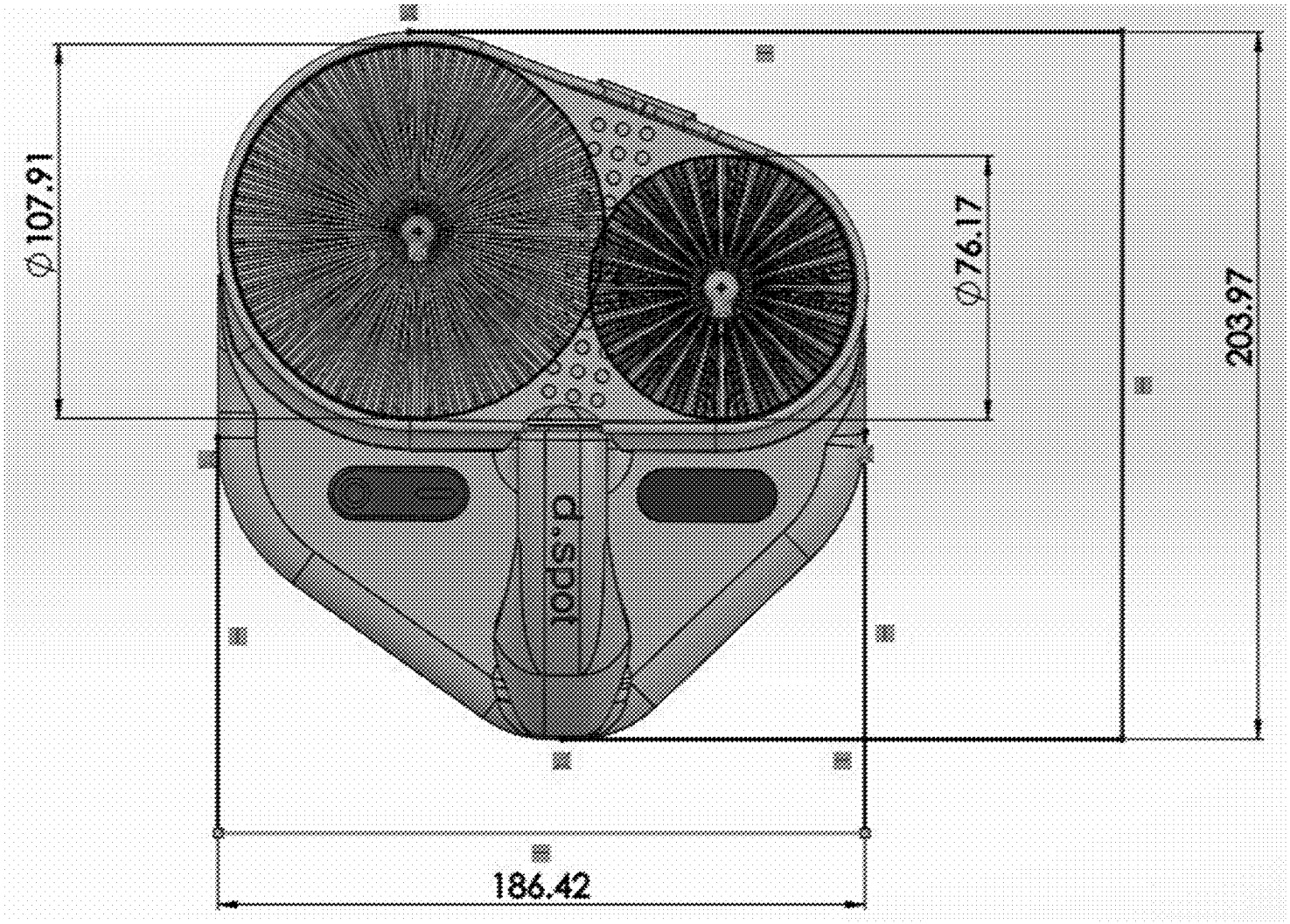
Figure 14C:
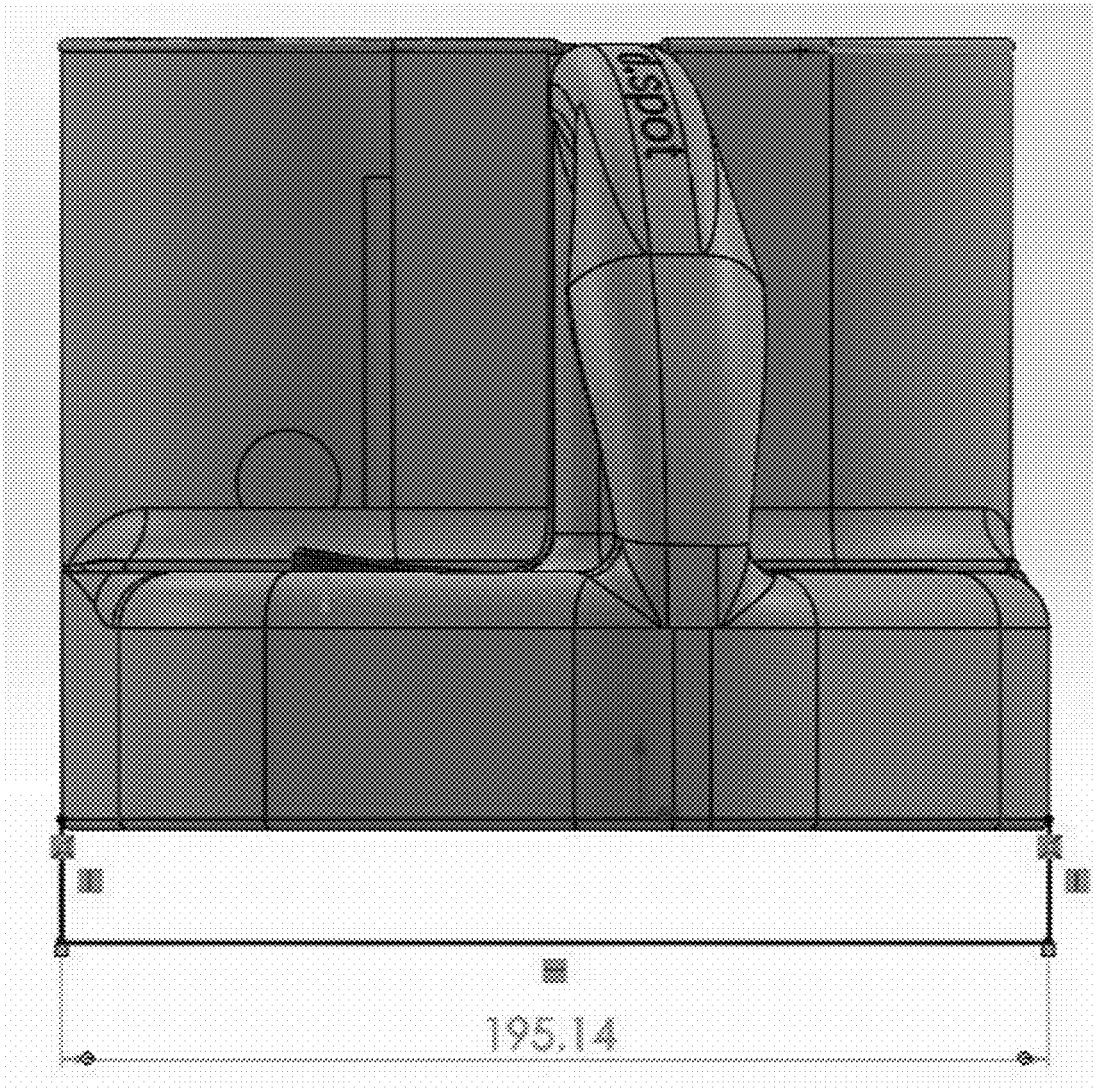

Example:

FIGS. 14A-14C provide images from the side, front, and top, respectively, illustrating the dimensions of one example of a glassware polishing system as disclosed herein. The illustrated dimensions are in mm. A glassware polishing system having these example dimensions and a rechargeable battery as a power source may weigh about three to five pounds which makes the glassware polishing system easily carried and portable.

Having thus described several aspects of at least one embodiment of this disclosure, it is to be appreciated that various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

What is claimed is:

1. A glassware polishing system comprising:

a base;

a wall extending upward from the base, the wall circumscribing and defining a chamber within an inner side of the wall;

a first polishing head having a first spindle extending upward from the base within the chamber and having a polishing material disposed about the first spindle;

a second polishing head having a second spindle extending upward from the base within the chamber and having a polishing material disposed about the second spindle; and at least one motor disposed in the base and configured to rotate the first polishing head about a first vertical axis of rotation defined by the first spindle and to rotate the second polishing head about a second vertical axis of rotation defined by the second spindle, the first polishing head and second polishing head arranged in a manner to simultaneously polish internal and external surfaces of the glassware when the first polishing head and second polishing head are rotated by the at least one motor; and a channel defined within and extending downward through a side of the wall, the channel configured to provide for insertion of one of a base of glassware or a portion of an item of silverware into the chamber from the side for polishing.

2. The system of claim 1, further comprising a power supply disposed in the base and operable to supply electrical power to the at least one motor.

3. The system of claim 2, wherein the power supply includes a rechargeable battery.

4. The system of claim 2, wherein the power supply is configured to provide amounts of power to the at least one motor to cause the at least one motor to operate at one of multiple available speeds selectable by a user of the system.

5. The system of claim 1, wherein the first polishing head has a diameter different from a diameter of the second polishing head.

6. The system of claim 1, wherein the polishing material of each of the first polishing head and the second polishing head includes strips or fibers of fabric.

7. The system of claim 6, wherein the strips or fibers of fabric include an antimicrobial agent.

8. The system of claim 7, wherein the antimicrobial agent includes silver.

9. The system of claim 1, wherein the wall includes a lower end removably coupled to an upper portion of the base.

10. The system of claim 1, wherein the base includes an upper wall defining a bottom of the chamber and air flow channels passing through the upper wall.

11. The system of claim 1, further comprising a handle coupled to the base and removably coupled to a channel or detent in an outer side of the wall.

12. The system of claim 11, wherein one of the wall or the handle includes labelling.

13. The system of claim 1, wherein the first polishing head and the second polishing head are each removably coupled to a respective shaft of the at least one motor.

14. The system of claim 1, further comprising an insert formed of a compliant material disposed on the inner side of the wall.

15. The system of claim 14, wherein the insert includes a bead disposed on an upper edge of the wall.

16. The system of claim 14, wherein the insert is removable and replaceable.

17. The system of claim 1, wherein the polishing material of each of the first polishing head and the second polishing head includes silver fibers.

18. The system of claim 1, further comprising a handle coupled to and extending upward from the base and removably coupled to a channel or detent in an outer side of the wall.

19. The system of claim 1, wherein the at least one motor includes a first motor disposed in the base and configured to rotate the first polishing head about the first vertical axis of rotation defined by the first spindle at a first speed and a second motor disposed in the base and configured to rotate the second polishing head about the second vertical axis of rotation defined by the second spindle at a second speed different from the first speed.

* * * * *